US005249693A

United States Patent [19]

Gillispie et al.

[11] Patent Number: 5,249,693

[45] Date of Patent: Oct. 5, 1993

[54] PLASTIC WASTE CAN FOR OILY WASTE

[75] Inventors: John G. Gillispie; Donald J. Mitchell, both of Wellsburg, W. Va.

[73] Assignee: Eagle Manufacturing Company, Wellsburg, W. Va.

[21] Appl. No.: 950,815

[22] Filed: Sep. 24, 1992

[51] Int. Cl.[5] ..... B65D 43/26

[52] U.S. Cl. ..... 220/263; 220/260; 220/262; 220/264; 220/908

[58] Field of Search ..... 220/260, 262, 263, 264, 220/334, 908

[56] References Cited

U.S. PATENT DOCUMENTS

| | | | |
|---|---|---|---|
| 1,236,429 | 8/1917 | Hansen . | |
| 1,601,930 | 10/1926 | Suddendorf . | |
| 1,754,802 | 4/1930 | Raster . | |
| 2,001,445 | 5/1935 | Abele | 220/263 |
| 2,216,279 | 11/1940 | Packer . | |
| 2,910,206 | 10/1959 | Hodgson | 220/263 X |
| 3,450,297 | 6/1969 | Clerk . | |
| 4,200,197 | 4/1980 | Meyer et al. | 220/263 |
| 4,785,964 | 11/1988 | Miller et al. | 220/263 |
| 4,836,394 | 6/1989 | Glomski | 220/908 X |
| 4,865,214 | 9/1989 | Koda et al. | 220/263 |
| 4,913,308 | 4/1990 | Culbertson | 220/404 |
| 4,953,740 | 9/1990 | Koda | 220/263 |
| 4,972,966 | 11/1990 | Craft, Jr. | 220/264 |
| 5,048,712 | 9/1991 | Wolters | 220/262 |
| 5,125,526 | 6/1992 | Sumanis | 220/263 |
| 5,147,055 | 9/1992 | Samson et al. | 220/254 |

*Primary Examiner*—Allan N. Shoap
*Assistant Examiner*—Vanessa Caretto
*Attorney, Agent, or Firm*—Armstrong, Westerman, Hattori, McLeland & Naughton

[57] ABSTRACT

A plastic waste can for collection of flammable waste has a self-closing cover disposed on a body portion or receptacle. A foot pedal situated in a channel formed in the bottom wall of the body portion and pivotally secured therein is depressed by a user to raise a lift bar which engages the cover to raise the cover. A cover lift accelerator is provided on the undersurface of the cover, with a hinge pin hingedly connecting the cover to the body portion through first and second hinge pin supports. The cover is arranged to open to no more than 70° to the horizontal so as to assure that the cover will close, by gravity, upon release of the foot pedal by a user.

12 Claims, 6 Drawing Sheets

PLASTIC WASTE CAN FOR OILY WASTE

BACKGROUND OF THE INVENTION

The present invention relates to a plastic waste can preferably for the collection of oily wastes such as oily rags or other combustible material.

Waste cans for the collection of oily wastes, such as oily rags used around machinery, must provide functions that conventional waste cans do not provide. The cans must be sturdy and provided with a cover to close off the receptacle of the waste can. Also, a user should be able to open the cover without the use of hands and the cover must be self-closing so that a user need not take any action to close the cover. This ensures that the cover will be closed and the contents closed off from the environment regardless of the actions of the user at all times, except when one deposits or removes the oily wastes.

Early examples of such oily waste cans are described in U.S. Pat. Nos. 1,236,429, 1,601,930, 1,754,802 and U.S. Pat. No. 2,216,279. Such oily waste cans, as well as an earlier waste can manufactured and sold by the assignee of the present invention were formed from metal and required stamping and forming of metal parts and welding, soldering, riveting or otherwise connecting various parts together to form an assembled waste receptacle which involved expense of time and material. In the aforementioned earlier metal waste of the present assignee, a triangular shaped metal receptacle portion was provided with a pivotally mounted metal cover, the cover attached to a pair of links that were, in turn, attached to a foot pedal for pivotal movement to open the cover. The cover had a downwardly extending lip around its periphery with the flat surface of the cover resting on the upper rim of the receptacle. An upstanding stop member, secured to the rear wall of the receptacle prevented the cover from opening beyond a range that would prevent the cover from closing of its own weight when the foot pedal was released.

Such earlier oily waste receptacles are expensive to produce both because of material costs as well as labor costs in assembling the receptacles.

It is an object of the present invention to provide a receptacle for oily wastes which is assembled from plastic units formed by blow molding of a thermoplastic material.

It is another object of the present invention to form a thermoplastic oily waste receptacle that is assembled by snap-fitting of components together and requires minimum labor for assembly.

It is a further object of the present invention to provide a thermoplastic waste receptacle that has a self-closing cover which is operable by a foot pedal.

SUMMARY OF THE INVENTION

A plastic waste can for collection of flammable waste, having a self-closing cover is formed from blow molded units that are readily assembled. The plastic waste can has a body portion formed as a receptacle with an open top, bottom wall and upstanding side wall that terminates in an upper rim. A channel is formed in the bottom wall transverse the body portion. A cover having a flat member and downwardly depending skirt about the periphery closes the open top of the receptacle.

A foot pedal is pivotally secured in the channel in the bottom wall and has a front portion for depression by the foot of a user and a rear portion that extends outwardly from the side wall of the body portion and has a pivot member at the end thereof to which a lift bar is attached. The lift bar extends vertically and has a lower end pivotally secured to the rear portion of the foot pedal such that, upon depressing of the front portion of the foot pedal, the lift bar will be raised to contact and open the cover.

A first hinge pin support is provided on the body portion extending outwardly therefrom adjacent to the rim, and a second hinge pin support is provided on the downwardly depending skirt on the cover which is complementary with and fits over the first hinge pin support. The lift bar passes through a lift bar aperture in the lower wall of the first hinge pin support and preferably has a sealing flange thereabout which is adapted to seal the lift bar aperture when the cover is in closed position. A cover lift accelerator is provided on the lower surface of the cover that accelerates opening of the lid upon contact by the lift bar.

The foot pedal preferably has pivot lugs extending outwardly from the side walls thereof which are engaged in recesses in inwardly directed walls forming the channel in the body portion, and the foot pedal is mounted such that depression of the front section of the foot pedal will cause the front section to contact a surface on which the waste can rests prior to opening of the cover to an angle of about 70° to the horizontal.

BRIEF DESCRIPTION OF THE DRAWINGS

The present invention will be more readily understood from the following description, with reference to the accompanying drawings, wherein.

DETAILED DESCRIPTION

Figure 1:
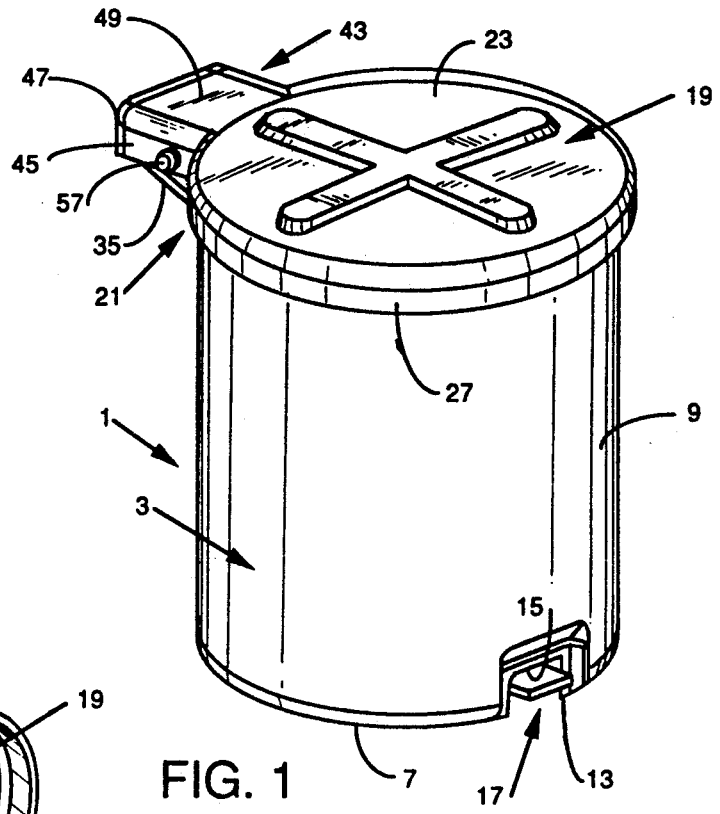
FIG. 1 is a perspective view of a preferred embodiment of the plastic waste can for oily waste of the present invention showing the cover in closed position.
Figure 2:
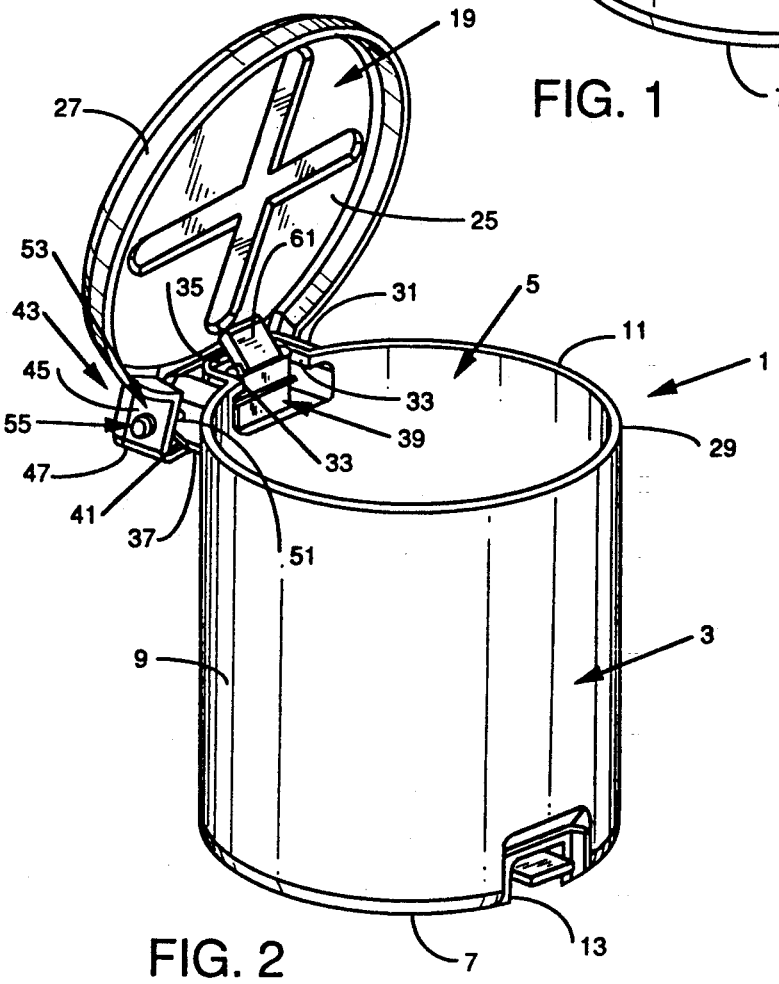
FIG. 2 is a view similar to FIG. 1 showing the cover in open position.
Figure 3:
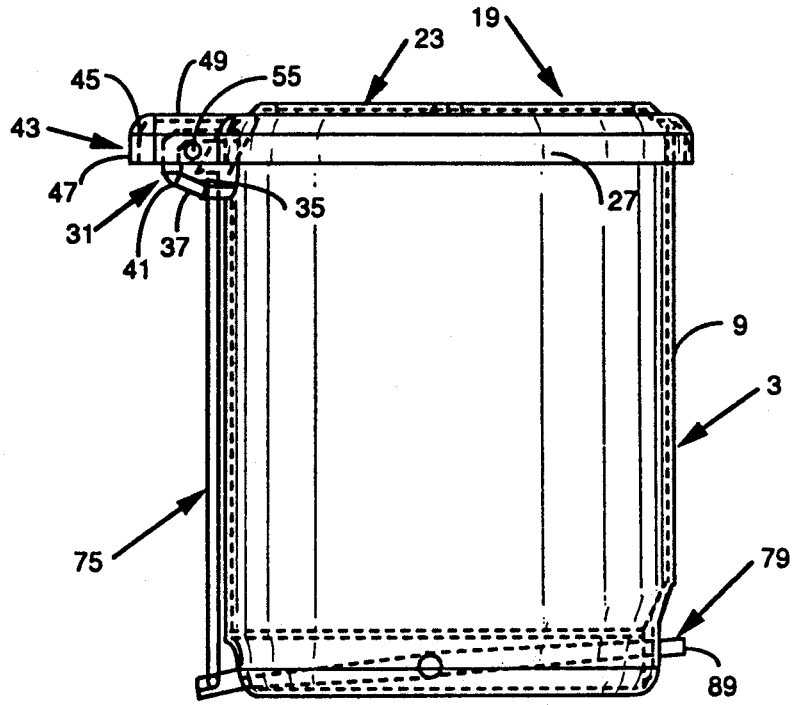
FIG. 3 is a side view of the plastic waste can of FIG. 1 showing the cover in closed position.
Figure 4:
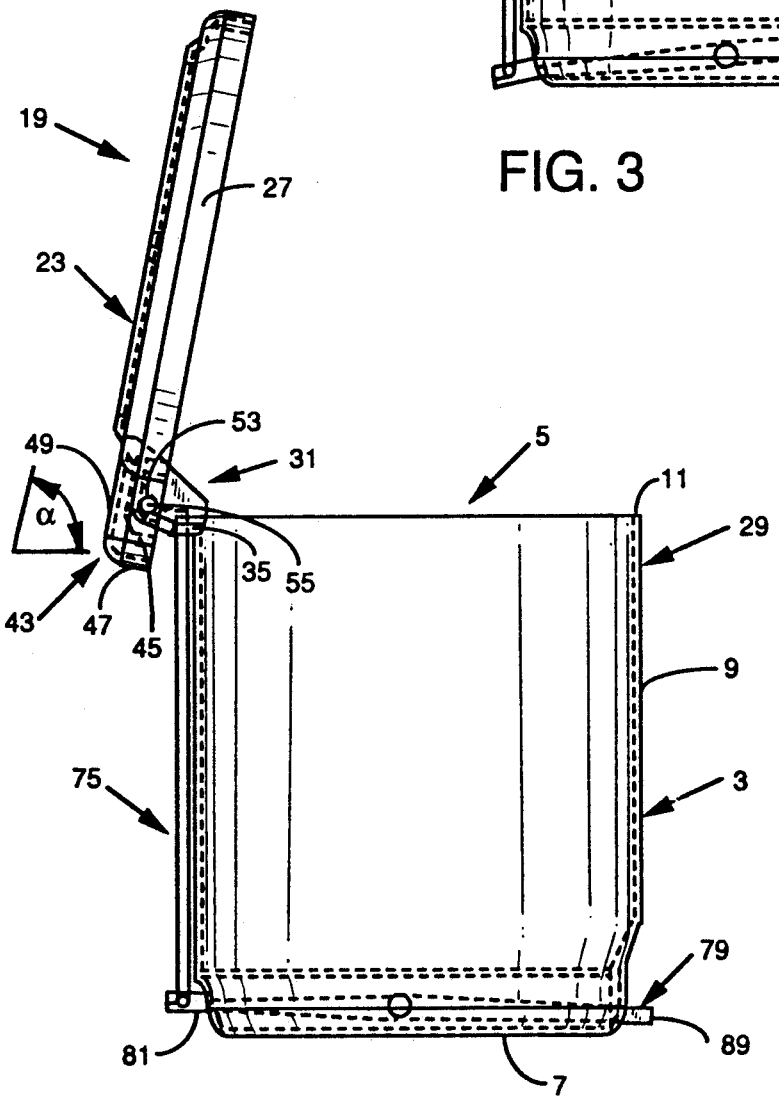
FIG. 4 is a view similar to FIG. 3 showing the cover in open position.
Figure 5:
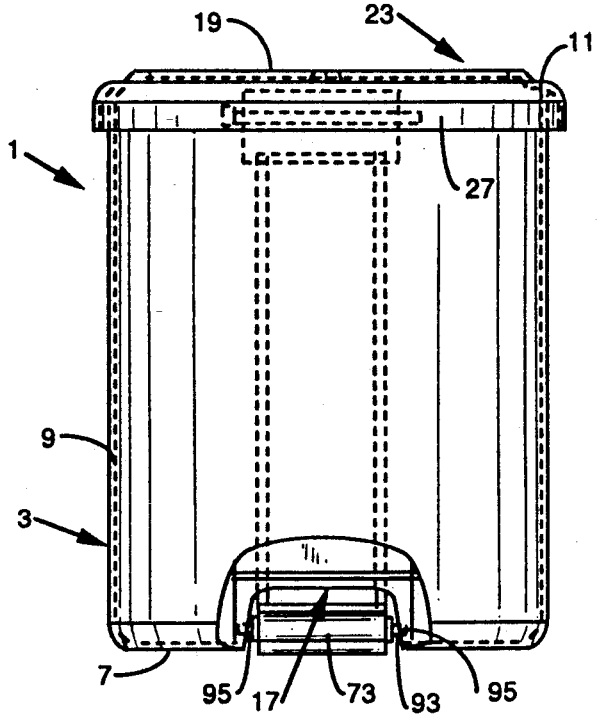
FIG. 5 is a front view of the plastic waste can of FIG. 1 showing the cove in closed position.
Figure 6:
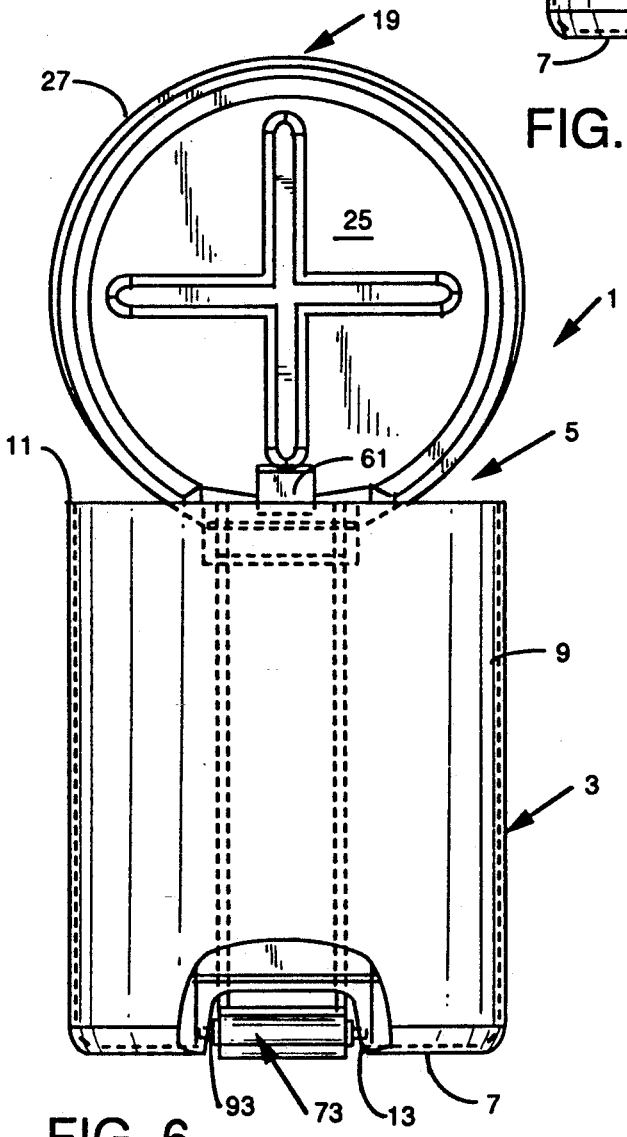
FIG. 6 is a view similar to FIG. 5 showing the cover in open position.

The plastic waste can of the present invention is especially suited for the purpose of collecting oily rags or other combustible material, and has a self-closing lid to prevent exposure of the contents of the waste can to the environment, except during placement or removal of such contents from the can. The plastic waste can is formed from blow molded units or components from a thermoplastic material, such as a high density polyethylene, which may be blow molded, which reduces expense in making such units, and the units are easily and quickly assembled by a user which also reduces labor costs.

Referring now to the drawings, FIGS. 1–6 illustrate the assembled plastic waste can 1, which has a body portion 3 that is formed as a receptacle having an open top 5, a bottom wall 7, and an upstanding side wall 9 which terminates in an upper rim 11. The bottom wall 7 is provided with spaced inwardly directed walls 13 extending from the front to the rear of the body portion, the spaced inwardly directed walls 13 connected by a base 15, the spaced inwardly directed walls 13 and base 15 forming a channel 17 extending from the front to the rear of the receptacle or body portion 3. The body portion 3 is provided with a cover 19 and a means 21 for opening the cover 19.

The cove 19 is adapted to close the open top 5 of the body portion 3 and has a substantially flat member 23, the lower surface 25 of the periphery thereof which is adapted to contact the upper rim 11 of the upstanding side wall 9, and a downwardly depending skirt 27 about the periphery thereof which, when the cover is closed on the body portion 3, fits over and surrounds the upper portion 29 of the upstanding side wall 9 adjacent the rim 11. Formed on the upper portion 29 of the upstanding side wall 9 of the body portion 3, in vertical alignment with the channel 17 in the bottom wall 7, is a first hinge pin support 31, which extends outwardly from the side wall 9, which has opposed side walls 33, end wall 35 and a lower wall 37, which lower wall 37 has a lift bar aperture 39 formed therein. The rear portion 41 of the lower wall 37 is preferably inclined upwardly, while the end wall 35 is of a generally arcuate or stepped shape. The cover 19 has a second hinge pin support 43 which extends outwardly from the downwardly depending skirt 27, which is complementary to the first hinge pin support 31. The second hinge pin support 43 has opposed side walls 45, an end wall 47, and an upper wall 49, and is adapted to fit over the first hinge pin support 31 and receive the first hinge pin support 31 within the confines thereof. Aligned hinge pin openings 51 are formed in the opposed side walls 33 of the first hinge pin support 31, which are also in alignment with further hinge pin openings 53 in the opposed side walls 45 of the second hinge pin support 43, and a hinge pin 55 passes through and is secured in openings 51 and 53. The hinge pin 55 preferably has a head 57 at one end and an exposed portion at the other end that may be provided with a cap (not shown).

Figure 7:
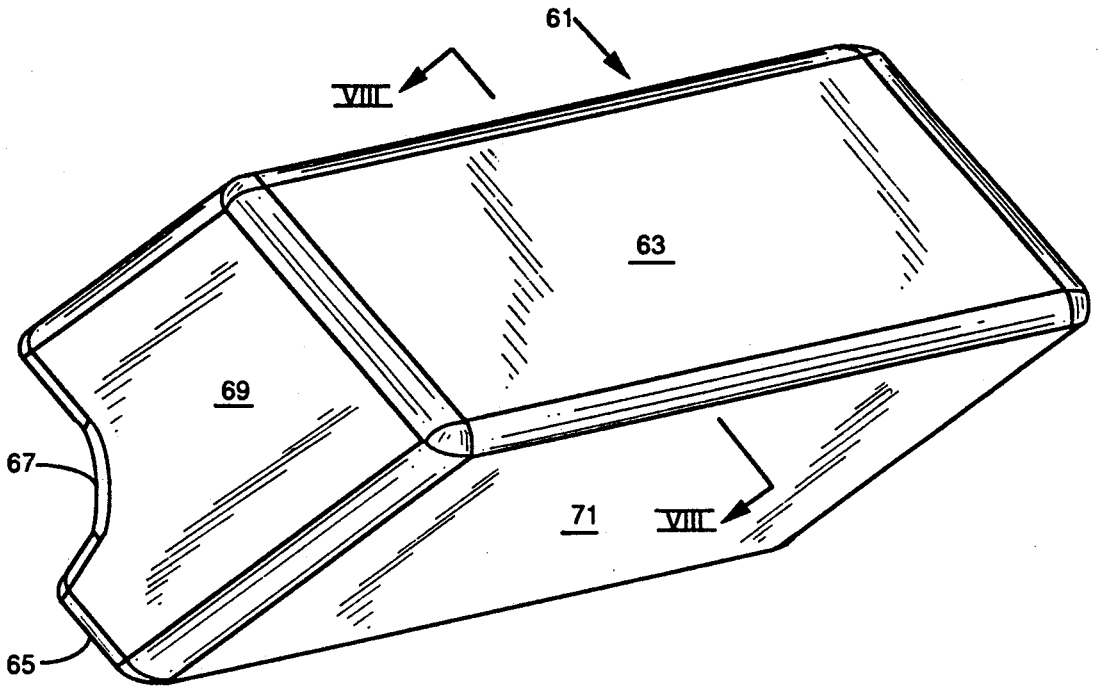
FIG. 7 is a perspective view of a cover lift accelerator used in the plastic waste can of the present invention, separated from the cover.
Figure 8:
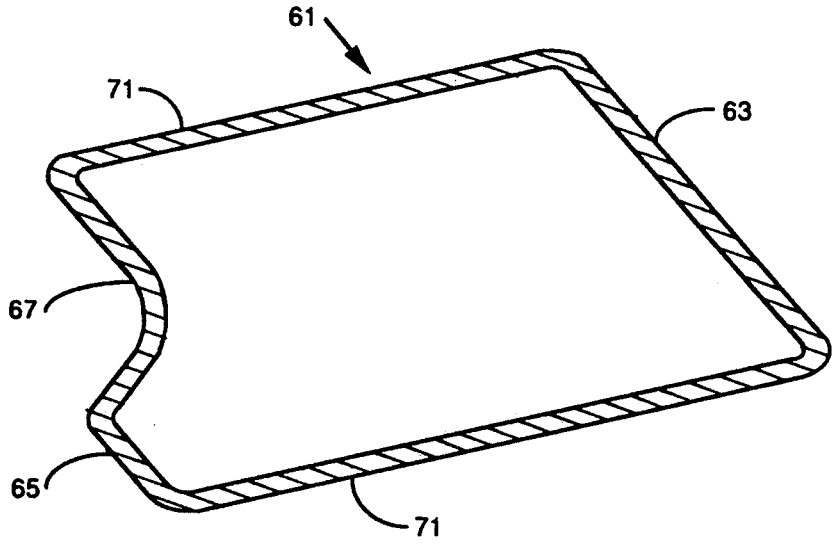
FIG. 8 is a cross-sectional view taken along lines VIII—VIII of FIG. 7.

A cover lift accelerator 61 is provided, that is secured, such as by riveting or welding, to the lower surface 25 of the flat member 23 of cover 19. The cover lift accelerator 61 (FIGS. 7 and 8) has a top 63 secured to the cover 19 and a bottom surface 65 which has a curved concave portion 67. The cover lift accelerator 61 is disposed on the cover 19 at a location such that the curved concave portion 67 overlies the lift bar aperture 39 in the lower wall 37 of the first hinge pin support 31. The cover lift accelerator 61 is also preferably blow molded and is hollow, so as to conserve material and labor. Thus, side walls 69, end walls 71, top 63 and bottom surface 65 comprise a hollow member securable to the cover 19.

Figure 9:
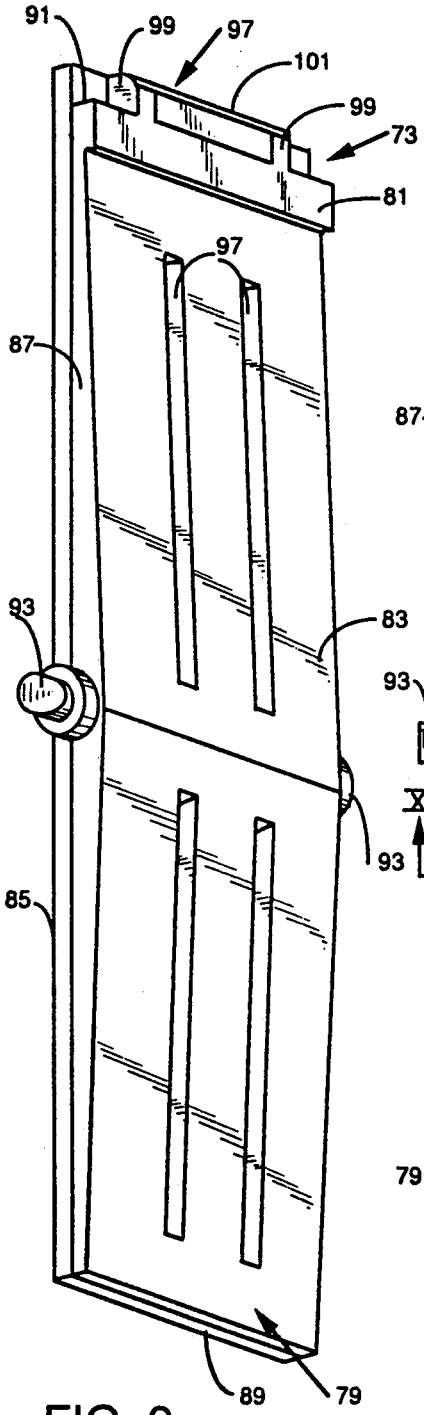
FIG. 9 is a perspective view of a foot pedal used in the plastic waste ca of the present invention.
Figure 10:
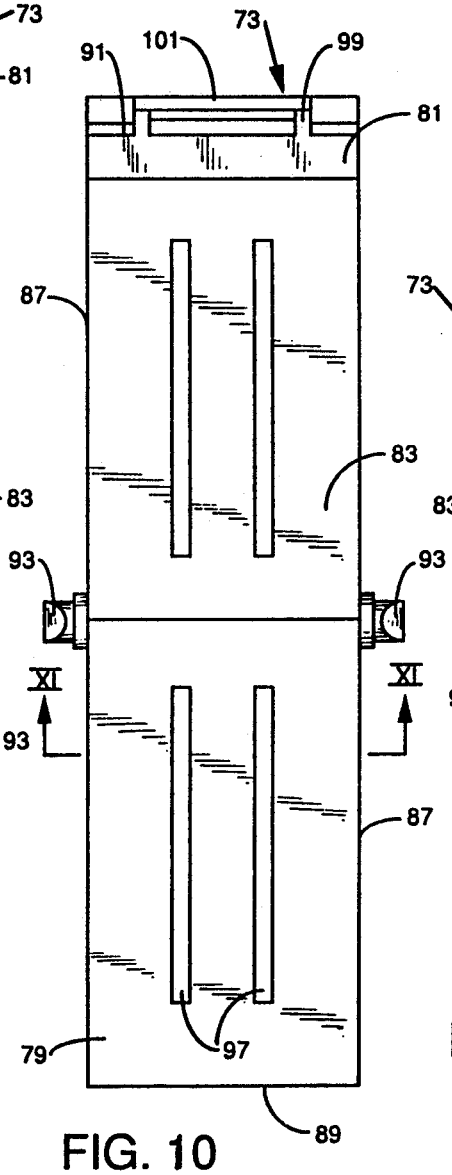
FIG. 10 is a plan view of the foot pedal illustrated in FIG. 9.
Figure 11:
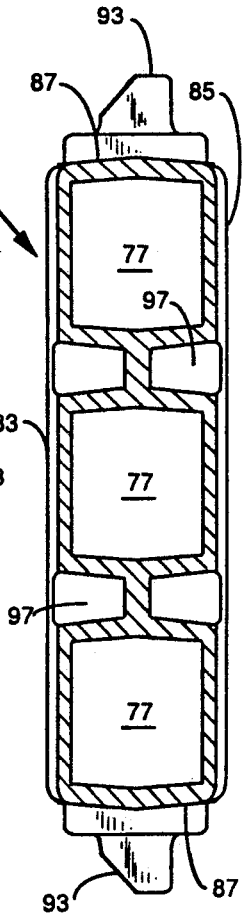
FIG. 11 is a cross-sectional view taken along lines XI—XI of FIG. 10.
Figure 12:
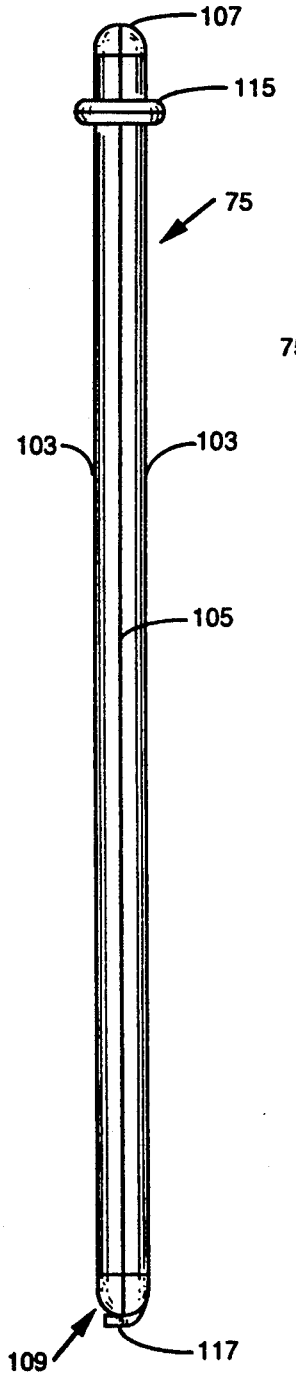
FIG. 12 is a side view of a lift bar used in the plastic waste can of the present invention.
Figure 13:
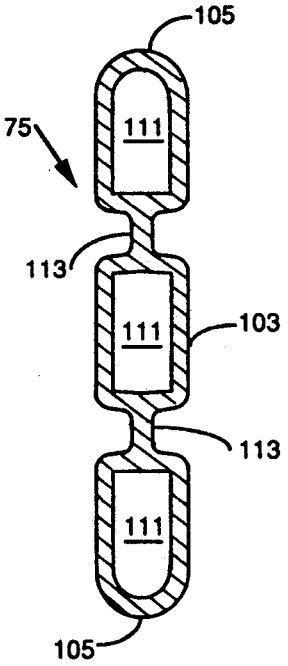
FIG. 13 is a cross-sectional view taken along lines XIII—XIII of FIG. 14.
Figure 14:
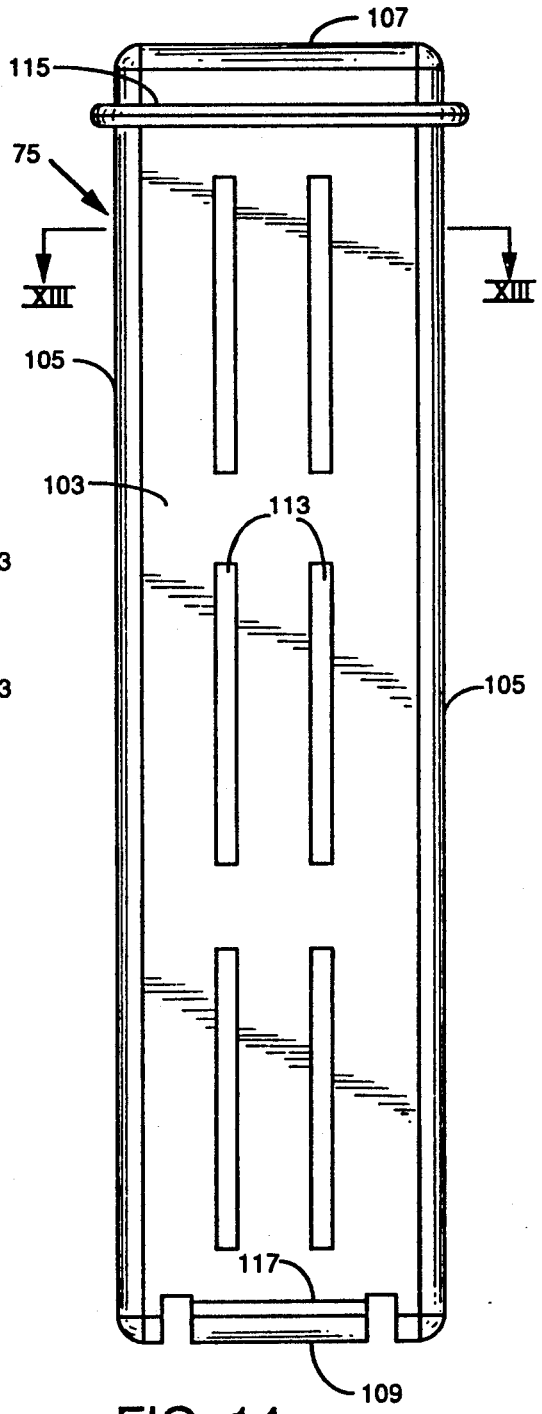
FIG. 14 is a front elevational view of the lift bar shown in FIG. 12.

The means 21 for opening the cover includes a foot pedal 73 and lift bar 75. As best illustrated in FIGS. 9–11, the foot pedal 73, blow molded and having spaced hollow chambers 77 therein, is comprised of a front portion 79 and rear portion 81. The foot pedal 73 is formed with upper wall 83, lower wall 85, side walls 87, and end walls 89, 91 at the front and rear, respectively, thereof. Extending outwardly from the side walls 87 of the foot pedal 73, between its front and rear portions 79 and 81 are pivot lugs 93. The pivot lugs 93 are sized to be accepted in opposed recesses 95 in the inwardly directed walls 13 of the bottom wall 7 of the body portion 3, with the bulk of the length of the foot pedal 73 received within channel 17. Cavities 97 are formed in the upper and lower walls 83 and 85 of the foot pedal. The foot pedal 73 has, adjacent the rear end wall 91, a lift bar catch 97, which may comprise a pair of spaced ears 99 and a pivot rod 101 extending between the ears 99, for use in pivotal connection of the lift bar 75 to the foot pedal 73. As shown in FIGS. 12–14, the lift bar 75, also a blow molded component, with lateral end walls 103, side walls 105, top wall 107 and bottom wall 109, also has spaced hollow chambers 111 therein, while cavities 113 are formed in the lateral end walls 103. Adjacent the top wall 107 of the lift bar 75 is a sealing flange 115 which extends outwardly about the lift bar 75, while at the bottom wall 109 there is provided a lift bar hook 117, which is adapted to engage with the pivot rod 101 of the foot pedal 73.

The cover lift accelerator 61, is secured to the lower surface 25 of the flat member 23 of cover 19 so as to overlie the lift bar aperture 39 and the lift bar 75 passing through the aperture 39. The top wall 107 of the lift bar 75, which is preferably rounded, will contact the cover lift accelerator 61 at the curved concave portion 67 of the bottom surface 65 and through such contact will accelerate the opening of the cover 19.

In order to assure that the cover 19 is self-closing, the lift bar 75 and cover lift accelerator 61 are designed such that upon maximum depression of the front portion 79 of the foot pedal 73, where the front portion 79 contacts a surface on which the plastic waste can 1 rests, the cover will be raised to no more than an angle $\alpha$ (FIG. 4) of 70° or less to a horizontal plane defined by the rim 11 of the upstanding side wall 9 of the body portion 3. With limitation of the angle $\alpha$ to 70° or less, the weight of the cover and influence of gravity will assure that the cover 19 will close itself onto the rim 11 upon release of the force on the front portion 79 of the foot pedal 73. Thus, the cover 19 will only be open upon depression of the foot pedal 73, for insertion or removal of contents of the plastic waste can 1 and will at all other times remain in closed position to close off the contents of the plastic waste can 1 from the surrounding environment.

As described, the body portion 3, cover 19, foot pedal 73 and lift bar 75 are all blow molded units. The body portion 3 and cover 19, for example, may be blow molded together in a single mold with flashing therebetween, and the flashing trimmed to separate those two units. The foot pedal 73 is blow molded, with spaced hollow chambers 77 formed therein, while cavities 97 are formed in the upper and lower walls 83 and 85 to provide strengthening and stability for the foot pedal 73. The lift bar 75 is also blow molded, with spaced hollow chambers 111, and with cavities 113 formed therein for strengthening and stability of the lift bar 75. The cover lift accelerator 61 is also blow molded and has a hollow therein. Since all of these units of the plastic waste can 1 are thus blow molded, expense of production is reduced, and savings in plastic material is effected because of the hollows in the foot pedal 73 and lift bar 75, while sufficient rigidity is maintained. The assembly of the plastic waste can is readily and inexpensively achieved merely by snapping the pivot lugs 93 of the foot pedal 73 into the recesses 95 in the inwardly directed walls 13 forming channel 17. Then, the lift bar 75 is inserted downwardly through the lift bar aperture 39 in the lower wall 37 of the first hinge pin support 31, and engaging the lift bar hook 117 with the pivot rod 101 on the foot pedal 73. The cover 19 is then placed over the open top 5 of the body portion 3, with the second hinge pin support 43 overlying the first hinge pin support 31, and with the hinge pin openings 51 and 53 in alignment. A hinge pin 55 is then inserted through the hinge pin openings and secured therein to provide a hinge member about which the cover 19 may be raised and lowered.

When the cover 19 is in closed position on the body portion 3, the flange 115, about the lift bar 75, contacts the lower wall 37 of the first hinge pin support 31 to close the same, while the lower surface 25 of the flat member 23 of cover 19 is in contact with the upper rim 11 of the upstanding side wall 9 of the body portion to close off the contents of the plastic waste can i from the surrounding environment. The second hinge pin support 43 fits over the first hinge pin support 31, such that a seal is also formed between these two units of the plastic waste can 1.

What is claimed is:

1. A plastic waste can for the collection of flammable waste and having a self-closing cover comprising:

a body portion formed as a receptacle having an open top, a bottom wall and an upstanding side wall terminating at an upper rim, said bottom wall having two spaced inwardly directed walls and a base therein forming a channel transverse said body portion;

a first hinge pin support on said body portion extending outwardly from said side wall, said first hinge pin support having a lower wall through which a lift bar aperture is formed, a second hinge pin support on said cover extending outwardly from said downwardly depending skirt complementary with and fitting over said first hinge pin support of said body portion;

means for pivotal securement of a foot pedal in said channel between said spaced inwardly directed walls;

a cover closing said open top of said receptacle, said cover having a substantially flat member with a downwardly depending skirt about the periphery thereof;

a foot pedal having front and rear portions disposed in said channel attached to said pivotal securement means, with said front portion depressible by a foot of a user and said rear portion extending beyond the upstanding side wall of said receptacle; and, a vertically extending lift bar extending through the lift bar aperture formed in the lower wall of said first hinge pin support, having a lower end pivotally secured to said rear portion of said foot pedal, said lift bar having a sealing flange thereabout which contacts the lower wall of said first hinge pin support to seal said lift bar aperture when said cover is closed on said receptacle, with said lift bar arranged such that upon depressing of the front portion of said foot pedal, said lift bar will be raised to contact and open said cover.

2. A plastic waste can for the collection of flammable waste as defined in claim 1 wherein said first hinge pin support on said body portion has opposed side walls with aligned hinge pin openings therethrough, and said second hinge pin support member of said cover has opposed side walls with further aligned hinge pin openings therethrough, and a hinge pin passes through and is secured in said openings.

3. A plastic waste can for the collection of flammable waste as defined in claim 1 wherein said body portion, cover, foot pedal and lift bar are blow molded plastic units and said foot pedal and lift bar have hollow chambers therein.

4. A plastic waste can for the collection of flammable waste as defined in claim 1 wherein said foot pedal is pivotally mounted in said channel spaced from said bottom wall a distance such that upon depression of said front section of said foot pedal, said front section will contact a surface on which said waste can rests prior to opening said cover to on angle of about 70° to the horizontal.

5. A plastic waste can for the collection of flammable waste and having a self-closing cover comprising:

a body portion formed as a receptacle having an open top, a bottom wall and an upstanding side wall terminating at an upper rim, said bottom wall having two spaced inwardly directed walls and a base therein forming a channel transverse said body portion;

means for pivotal securement of a foot pedal in said channel between said spaced inwardly directed walls;

a cover closing said open top of said receptacle, said cover having a substantially flat member with a downwardly depending skirt about the periphery thereof;

a foot pedal having front and rear portions disposed in said channel attached to said pivotal securement means, with said front portion depressible by a foot of a user and said rear portion extending beyond the upstanding side wall of said receptacle;

a vertically extending lift bar having a lower end pivotally secured to said rear portion of said foot pedal, arranged such that upon depressing of the front portion of said foot pedal, said lift bar will be raised to contact and open said cover; and a cover lift accelerator secured to a lower surface of said cover, said cover lift accelerator having a bottom surface with a concave portion arranged to be contacted by said lift bar upon depression of said front portion of said foot pedal.

6. A plastic waste can for the collection of flammable waste as defined in claim 5 including opposed recesses in the inwardly directed walls of the bottom wall of said body portion, and pivot lugs extending outwardly from side walls of said foot pedal, said lugs received in said recesses to pivotally secure said foot pedal in said channel.

7. A plastic waste can for the collection of flammable waste as defined in claim 5 wherein said body portion, cover, foot pedal and lift bar are blow molded plastic units and said foot pedal and lift bar have hollow chambers therein.

8. A plastic waste can for the collection of flammable waste as defined in claim 5 wherein said foot pedal is pivotally mounted in said channel spaced from said bottom wall a distance such that upon depression of said front section of said foot pedal, said front section will contact a surface on which said waste can rests prior to opening said cover to on angle of about 70° to the horizontal.

9. A plastic waste can for the collection of flammable waste and having a self-closing cover comprising:

a body portion formed as a receptacle having an open top, a bottom wall and an upstanding side wall terminating at an upper rim, with a first hinge pin support on said body portion extending outwardly form said side wall, said first hinge pin support having a lower wall through which a lift bar aperture is formed, and said bottom wall having two spaced inwardly directed walls and a base therein forming a channel transverse said body portion;

means for pivotal securement of a foot pedal in said channel between said spaced inwardly directed walls;

a cover closing said open top of said receptacle, said cover having a substantially flat member with a downwardly depending skirt about the periphery thereof and a second hinge pin support extending outwardly from said downwardly depending skirt complementary with and fitting over said first hinge pin support of said body portion;

a foot pedal having front and rear portions disposed in said channel attached to said pivotal securement means, with said front portion depressible by a foot of a user and said rear portion extending beyond the upstanding side wall of said receptacle;

a vertically extending lift bar having a lower end pivotally secured to said rear portion of said foot pedal, said lift bar extending through the lift bar aperture of said first hinge pin support and arranged such that upon depressing of the front portion of said foot pedal, said lift bar will be raised to contact and open said cover; and a cover lift accelerator secured to a lower surface of said cover, said cover lift accelerator having a bottom surface with a concave portion arranged to be contacted by said lift bar upon depression of said front portion of said foot pedal.

10. A plastic waste can for the collection of flammable waste as defined in claim 9 including opposed recesses in the inwardly directed walls of the bottom wall of said body portion, side walls on said foot pedal, and pivot lugs extending outwardly from said side walls of said foot pedal, said lugs received in said recesses to pivotally secure said foot pedal in said channel.

11. A plastic waste can for the collection of flammable waste as defined in claim 9 wherein said body portion, cover, foot pedal and lift bar are blow molded plastic units and said foot pedal and lift bar have hollow chambers therein.

12. A plastic waste can for the collection of flammable waste as defined in claim 9 wherein said foot pedal is pivotally mounted in said channel spaced from said bottom wall a distance such that upon depression of said front section of said foot pedal, said front section will contact a surface on which said waste can rests prior to opening said cover to on angle of about 70° to the horizontal.

* * * * *